US011292688B2

(12) United States Patent
Matsunaga et al.

(10) Patent No.: US 11,292,688 B2
(45) Date of Patent: Apr. 5, 2022

(54) SHEET BODY CUTTING METHOD AND SHEET BODY CUTTING DEVICE

(71) Applicant: HONDA MOTOR CO., LTD., Tokyo (JP)

(72) Inventors: Kazuki Matsunaga, Tochigi-ken (JP); Daigo Mukasa, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/505,787

(22) Filed: Jul. 9, 2019

(65) Prior Publication Data

US 2020/0017329 A1 Jan. 16, 2020

(30) Foreign Application Priority Data

Jul. 12, 2018 (JP) ..... JP2018-132027

(51) Int. Cl.
*B65H 35/00* (2006.01)
*B65H 35/06* (2006.01)

(52) U.S. Cl.
CPC ..... *B65H 35/0086* (2013.01); *B65H 35/06* (2013.01); *B65H 2701/1842* (2013.01)

(58) Field of Classification Search
CPC .. B65H 35/00; B65H 35/0073; B65H 35/008; B65H 35/0086; B65H 35/04; B65H 35/06
USPC ..... 83/236, 262, 282, 206, 277
See application file for complete search history.

(56) References Cited

U.S. PATENT DOCUMENTS 3,623,386 A * 11/1971 Bach et al. ..... B65H 35/00 83/151
3,729,886 A * 5/1973 Lucas ..... B65B 63/026 53/399
4,203,334 A * 5/1980 Zettler ..... B65H 5/24 270/58.33
4,270,910 A * 6/1981 Himmelsbach ..... B26D 7/1827 493/373
4,408,754 A * 10/1983 Meier ..... B65H 39/10 270/21.1
4,700,532 A * 10/1987 Redmond ..... B65B 11/50 53/452
4,778,165 A * 10/1988 Buck ..... B65H 31/10 270/39.02
5,192,064 A * 3/1993 Rusconi ..... B65H 35/04 270/52.01
2002/0101019 A1* 8/2002 Boss ..... B65H 5/32 270/58.08

(Continued)

FOREIGN PATENT DOCUMENTS

JP 2000-288863 10/2000
WO 2007/052362 5/2007

OTHER PUBLICATIONS

Japanese Office Action for Japanese Patent Application No. 2018-132027 dated Sep. 21, 2021.

*Primary Examiner* — Sean M Michalski
*Assistant Examiner* — Richard D Crosby, Jr.
(74) *Attorney, Agent, or Firm* — Amin, Turocy & Watson, LLP

(57) ABSTRACT

A sheet body is gripped (bound) by grip conveyance units, and conveyed as the grip conveyance units are displaced in this state. At the same time as this conveyance, the sheet body is held by delivering units, and delivered by a predetermined amount by the delivering units. After that, the sheet body is cut in predetermined size and shape by cutting molds.

3 Claims, 6 Drawing Sheets

(56) References Cited

U.S. PATENT DOCUMENTS

| | | | | |
|---|---|---|---|---|
| 2002/0170277 | A1* | 11/2002 | Kuchler | B26D 7/27 53/514 |
| 2003/0035671 | A1* | 2/2003 | Estabrooks | G03G 15/6523 399/385 |
| 2006/0191426 | A1* | 8/2006 | Timmerman | B31B 50/88 101/24 |
| 2011/0097127 | A1* | 4/2011 | Yoshida | B65H 7/00 399/406 |
| 2012/0111162 | A1* | 5/2012 | Kirchberg | D04H 3/04 83/23 |
| 2012/0111163 | A1* | 5/2012 | Baumuller | B26D 7/18 83/23 |
| 2013/0280484 | A1* | 10/2013 | Honegger | B32B 37/1292 428/138 |
| 2018/0226657 | A1* | 8/2018 | Mukasa | B26D 7/1863 |
| 2020/0001643 | A1* | 1/2020 | Leuenberger | B65H 29/16 |
| 2020/0017329 | A1* | 1/2020 | Matsunaga | B26D 7/06 |

* cited by examiner

SHEET BODY CUTTING METHOD AND SHEET BODY CUTTING DEVICE

CROSS-REFERENCE TO RELATED APPLICATION

This application is based upon and claims the benefit of priority from Japanese Patent Application No. 2018-132027 filed on Jul. 12, 2018, the contents of which are incorporated herein by reference.

BACKGROUND OF THE INVENTION

Field of the Invention

The present invention relates to a sheet body cutting method and a sheet body cutting device for cutting a sheet body in predetermined size and shape to obtain a cut piece.

Description of the Related Art

A sheet body is usually rolled into a roll body. To obtain a cut piece with a predetermined length, a part of the sheet body is delivered from the roll body by a cutting device and cut by a cutting mold that forms the cutting device. Japanese Laid-Open Patent Publication No. 2000-288863 discloses a delivering device corresponding to one example of the device that performs the above-mentioned delivery. This delivering device is provided to a punching device, and includes a fixed clamp that is positioned and fixed, a movable clamp that moves by the action of a liner motor, and winding rolls in this order from an upstream side.

In this delivering device, while punching is performed, the fixed clamp holds the sheet body and keeps the sheet body bound, and then, the movable clamp holds and binds the sheet body and the fixed clamp releases the sheet body from binding. Moreover, after the punching ends and before the next punching starts, the movable clamp moves. The sheet body with the amount corresponding to this moving amount is delivered to a downstream side, passes between the pair of winding rolls that rotates, and is wound on a reel.

SUMMARY OF THE INVENTION

In a structure described in Japanese Laid-Open Patent Publication No. 2000-288863, when the movable clamp moves, the winding rolls rotate. In this case, for example, if moving speed of the movable clamp is faster than rotation speed of the winding rolls, a wrinkle (twist or wave) is formed on a part of the sheet body between the movable clamp and the winding rolls. If the sheet body in this state is next cut and delivered, the sheet body may be broken at the position of the wrinkle.

A main object of the present invention is to provide a sheet body cutting method in which a wrinkle is formed less easily because the delivery accuracy is high.

Another object of the present invention is to provide a sheet body cutting device that can clear up the concern about the damage of the sheet body.

According to one aspect of the present invention to achieve the above objects, a sheet body cutting method for cutting a sheet body with cutting molds of a sheet body cutting device is provided, and the sheet body cutting method includes: a synchronous delivering step of positioning the sheet body at the cutting molds in a manner that holding units provided on an upstream side of the cutting molds and forming a holding member are separated from each other relatively so as to release the sheet body from the holding units, grip conveyance units forming a grip conveyance member grip and bind the sheet body and are displaced from the upstream side of the cutting molds toward the cutting molds, delivering units provided on a downstream side of the cutting molds and forming a delivering member are brought close to each other relatively so as to hold and bind the sheet body, and a part of the sheet body is delivered to a downstream side of the delivering member; and a cutting step of cutting the sheet body in a manner that the holding units are brought close to each other relatively so as to bind the sheet body, the delivering units keep the sheet body held, the grip conveyance units are displaced in directions in which the grip conveyance units are separated from each other relatively so as to release the sheet body from binding, and the cutting molds cut the sheet body that has been positioned at the cutting molds.

According to another aspect of the present invention, a sheet body cutting device including cutting molds that cut a sheet body is provided, and the sheet body cutting device includes: a holding member including holding units that are provided on an upstream side of the cutting molds, and configured to be displaced in directions in which the holding units are brought close to or separated from each other relatively, and that are configured to hold the sheet body when the holding units are brought close to each other; a grip conveyance member including grip conveyance units that are provided on a downstream side of the holding member, and configured to be displaced in directions in which the grip conveyance units are brought close to or separated from each other relatively, and that are configured to grip the sheet body when the grip conveyance units are brought close to each other and convey the sheet body to the cutting molds; a delivering member including delivering units that are provided on a downstream side of the cutting molds, and configured to be displaced in directions in which the delivering units are brought close to or separated from each other relatively, and that are configured to hold the sheet body when the delivering units are brought close to each other and deliver the sheet body from the cutting molds to the downstream side of the cutting molds; and a control member configured to control the holding member, the grip conveyance member, and the delivering member, wherein when the grip conveyance member grips and conveys the sheet body, the control member is configured to position the sheet body at the cutting molds by separating the holding units of the holding member relatively so as to release the sheet body, and by causing the delivering member to hold the sheet body and deliver a part of the sheet body to a downstream side of the delivering member.

By the present invention, a part of the sheet body that is positioned on the upstream side of the cutting molds is gripped (bound) and conveyed by the grip conveyance member, and at the same time, a part of the sheet body that is positioned on the downstream side of the cutting molds is delivered by the delivering member. By this synchronous delivery, the sheet body can be conveyed with higher accuracy. Thus, it is possible to suppress the occurrence of a wrinkle on the sheet body. Therefore, the concern about the damage of the sheet body can be cleared up.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of a sheet body cutting method according to the present invention and a sheet body cutting device that is related with the sheet body cutting method is described in detail with reference to the attached drawings. Note that the sheet body cutting device is also referred to as a "cutting device" simply.

Figure 1:
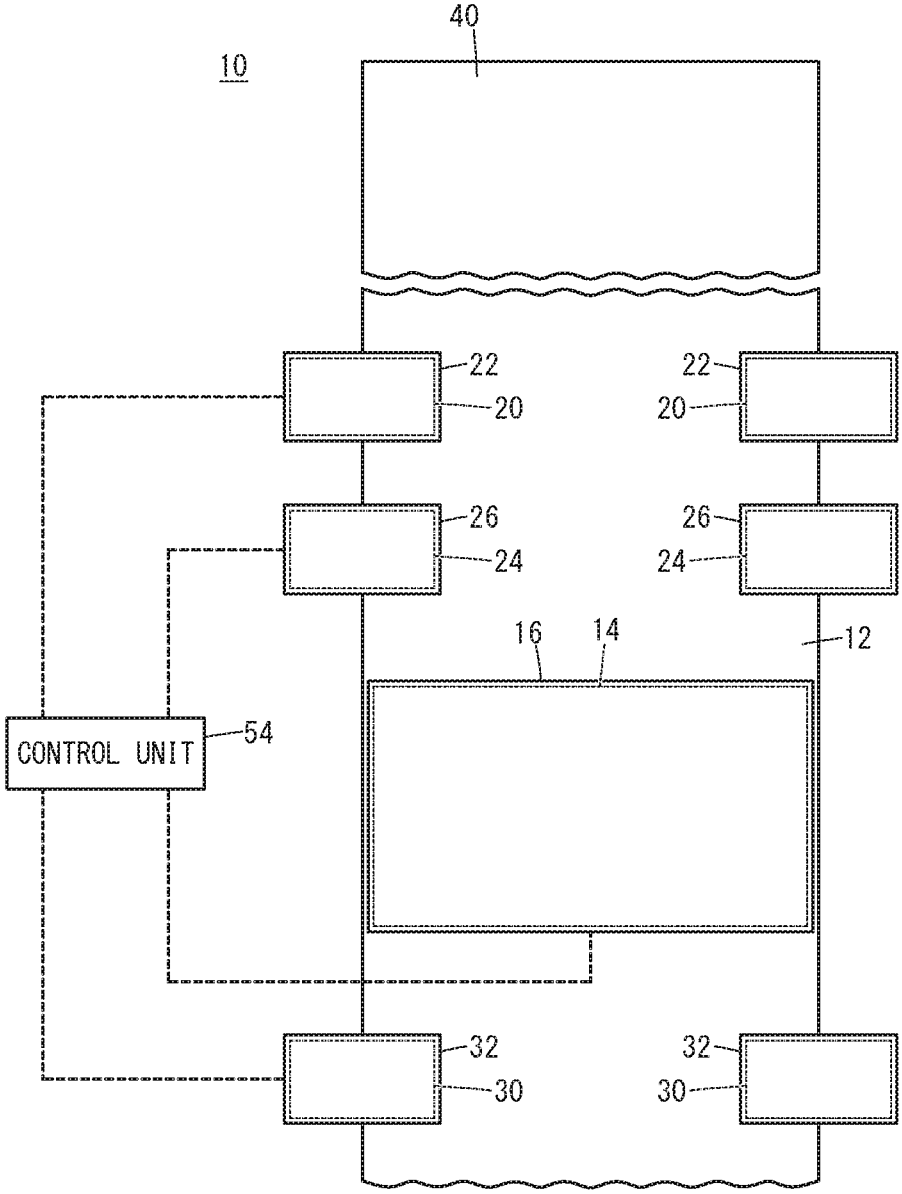
FIG. 1 is a schematic plan view of a main part of a sheet body cutting device according to one embodiment of the present invention.
Figure 2:
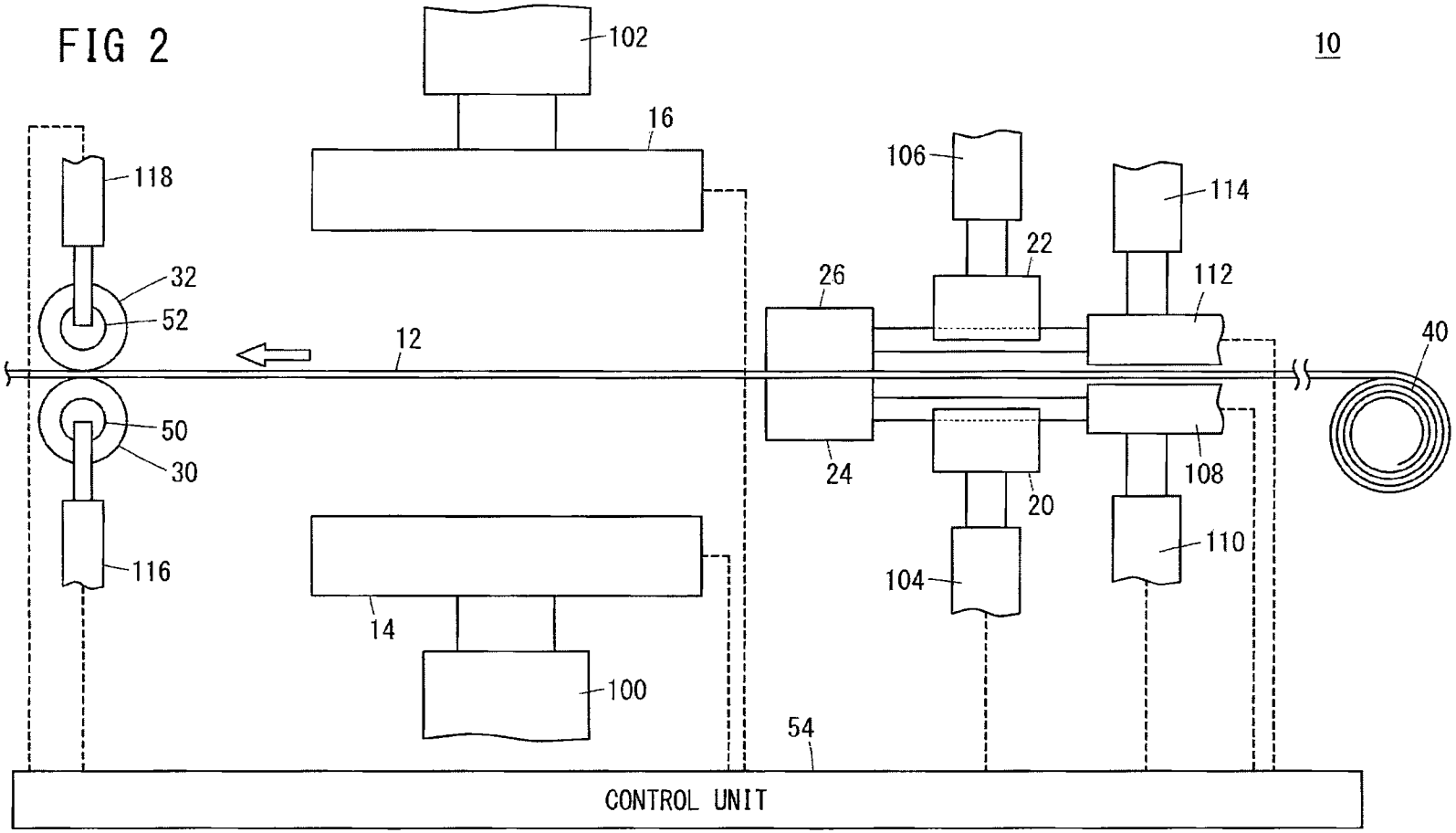
FIG. 2 is a schematic side view of the main part of the cutting device in FIG. 1.

FIG. 1 is a schematic plan view of a main part of a cutting device 10 according to the present embodiment, and FIG. 2 is a schematic side view of the main part of the cutting device 10 according to the present embodiment. This cutting device 10 is used to cut carbon paper 12 corresponding to the sheet body in predetermined size and shape, and includes a trim lower mold 14 and a trim upper mold 16 corresponding to cutting molds. In addition, this cutting device 10 includes two sets of lower fixed chucks 20 and upper fixed chucks 22 (holding units) that form a holding member, two pairs of lower grip feeds 24 and upper grip feeds 26 (grip conveyance units) that form a grip conveyance member, and two pairs of lower nip rollers 30 and upper nip rollers 32 (delivering units) that form a delivering member.

The carbon paper 12 is rolled into a roll body 40. From this roll body 40, the carbon paper 12 with a predetermined length is drawn out, and is cut in the predetermined size and the predetermined shape by the cutting device 10.

The trim lower mold 14 and the trim upper mold 16 are disposed between the lower fixed chucks 20 and the upper fixed chucks 22, and the lower nip rollers 30 and the upper nip rollers 32. The trim lower mold 14 can ascend or descend by a first lower up-and-down moving actuator 100 shown in FIG. 2. On the other hand, the trim upper mold 16 can descend or ascend by a first upper up-and-down moving actuator 102. Note that when the trim lower mold 14 ascends, the trim upper mold 16 descends, and when the trim lower mold 14 descends, the trim upper mold 16 ascends. In other words, the trim lower mold 14 and the trim upper mold 16 are displaced so as to be close to or separated from each other. When the trim lower mold 14 and the trim upper mold 16 are brought close to each other, the carbon paper 12 is cut. Note that one of the trim lower mold 14 and the trim upper mold 16 may be positioned and fixed, that is, a fixed mold, and the other may be able to be displaced, that is, a movable mold. In this case, the carbon paper 12 may be cut by moving the movable mold toward the fixed mold.

As described above, the lower fixed chuck 20 and the upper fixed chuck 22 are disposed on an upstream side of the trim lower mold 14 and the trim upper mold 16. These lower fixed chuck 20 and upper fixed chuck 22 can ascend or descend by a second lower up-and-down moving actuator 104 and a second upper up-and-down moving actuator 106, respectively. The second lower up-and-down moving actuator and the second upper up-and-down moving actuator are positioned and fixed. Note that the lower fixed chuck 20 and the upper fixed chuck 22 descend and ascend so as to be close to or separated from each other. When the lower fixed chuck 20 and the upper fixed chuck 22 are brought close to each other, the lower fixed chuck 20 and the upper fixed chuck 22 hold the carbon paper 12, that is, a bind state is obtained. On the other hand, when the lower fixed chuck 20 and the upper fixed chuck 22 are separated from each other, the carbon paper 12 is released from the holding, that is, a release state is obtained.

Since the second lower up-and-down moving actuator 104 and the second upper up-and-down moving actuator 106 are positioned and fixed, the lower fixed chuck 20 and the upper fixed chuck 22 can only ascend and descend. That is to say, the lower fixed chuck 20 and the upper fixed chuck 22 cannot be displaced along a paper surface direction of the carbon paper 12.

The lower grip feed 24 can be displaced in a horizontal direction by the action of a lower horizontal displacement actuator 108, and can ascend or descend by the action of a third lower up-and-down moving actuator 110. Similarly, the upper grip feed 26 can be displaced in the horizontal direction by the action of an upper horizontal displacement actuator 112, and can ascend or descend by the action of a third upper up-and-down moving actuator 114. As the horizontal displacement, the lower grip feed 24 and the upper grip feed 26 are displaced from the upstream side of the trim lower mold 14 and the trim upper mold 16 to a downstream side of the trim lower mold 14 and the trim upper mold 16. As the ascent and the descent, the lower grip feed 24 and the upper grip feed 26 are displaced so as to be close to or separated from the carbon paper 12. As described above, the lower grip feed 24 and the upper grip feed 26 are displaced from the upstream side to the downstream side of the trim lower mold 14 and the trim upper mold 16. Thus, the cutting device 10 can be structured with a small size.

When the lower grip feed 24 and the upper grip feed 26 are brought close to each other, the lower grip feed 24 and the upper grip feed 26 grip and bind the carbon paper 12. In this bind state, the lower grip feed 24 and the upper grip feed 26 are horizontally displaced so that the carbon paper 12 is conveyed. On the other hand, when the lower grip feed 24 and the upper grip feed 26 are separated from each other, the lower grip feed 24 and the upper grip feed 26 release the carbon paper 12 from binding. That is to say, the carbon paper 12 becomes the release state.

The lower nip roller 30 and the upper nip roller 32 are disposed on the downstream side of the trim lower mold 14 and the trim upper mold 16. To a rotation axis 50 of the lower nip roller 30 and a rotation axis 52 of the upper nip roller 32, a fourth lower up-and-down moving actuator 116 and a fourth upper up-and-down moving actuator 118 are connected respectively. The fourth lower up-and-down moving actuator 116 and the fourth upper up-and-down moving actuator 118 are positioned and fixed. The lower nip roller 30 and the upper nip roller 32 can descend or ascend by the action of the fourth lower up-and-down moving actuator 116 and the fourth upper up-and-down moving actuator 118. When the lower nip roller 30 and the upper nip roller 32 are brought close to each other, the lower nip roller 30 and the upper nip roller 32 hold the carbon paper 12, that is, the bind state is obtained. On the other hand, when the lower nip roller 30 and the upper nip roller 32 are separated from each other, the lower nip roller 30 and the upper nip roller 32 release the carbon paper 12, that is, the release state is obtained.

The fourth lower up-and-down moving actuator 116 and the fourth upper up-and-down moving actuator 118 are positioned and fixed. Thus, the lower nip roller 30 and the upper nip roller 32 can only ascend and descend, and cannot be displaced along the paper surface direction of the carbon paper 12.

The rotation axis 50 of the lower nip roller 30 and the rotation axis 52 of the upper nip roller 32 are connected to a rotation driving source such as a motor (not shown). That is to say, as the rotation driving source is energized, the rotation axes 50, 52 rotate. In accordance with the rotation of the rotation axes 50, 52, the lower nip roller 30 and the upper nip roller 32 rotate synchronously.

As illustrated in FIG. 1, one set of the lower fixed chuck 20 and the upper fixed chuck 22, one set of the lower grip feed 24 and the upper grip feed 26, and one set of the lower nip roller 30 and the upper nip roller 32 are positioned near a left end in a width direction that is orthogonal to a direction of delivering the carbon paper 12. The other sets are positioned near a right end in the width direction of the carbon paper 12. That is to say, the left end and the right end of the carbon paper 12 in the width direction are pressed.

In the above structure, the first to fourth lower up-and-down moving actuators 100, 104, 110, 116, the first to fourth upper up-and-down moving actuators 102, 106, 114, 118, the lower horizontal displacement actuator 108, the upper horizontal displacement actuator 112, and the rotation driving source are electrically connected to a control unit 54 corresponding to a control member. That is to say, the operation of these actuators 100, 102, 104, 106, 110, 112, 114, 116, 118 is controlled by the action of the control unit 54.

The cutting device 10 according to the present embodiment is basically structured as above. Next, the operation effect of the cutting device 10 and the sheet body cutting method according to the present embodiment that is related with the cutting device 10 are described. Note that the following steps are performed in accordance with sequence control by the control unit 54.

Figure 3:
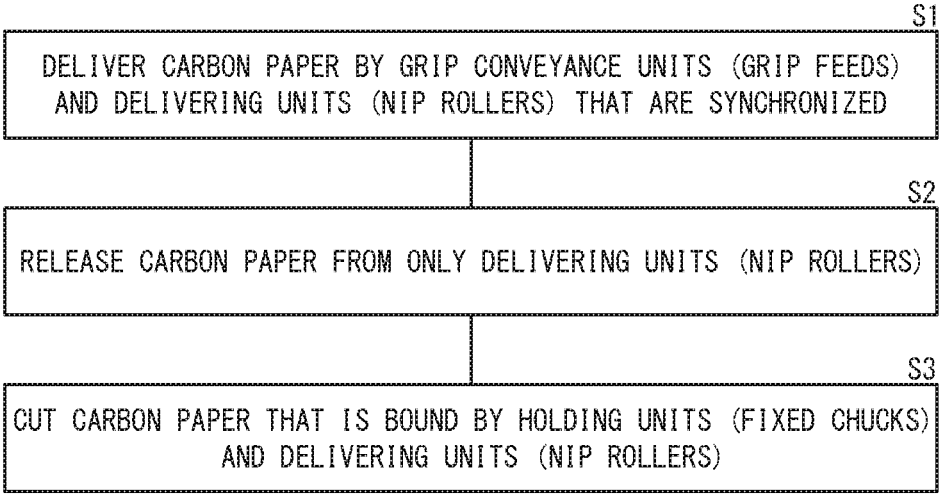
FIG. 3 is a schematic flowchart of a sheet body cutting method according to the embodiment of the present invention.

FIG. 3 is a schematic flowchart of the cutting method according to the present embodiment. This cutting method includes: a synchronous delivering step S1 of delivering the carbon paper 12 by the lower grip feed 24 and the upper grip feed 26, and the lower nip roller 30 and the upper nip roller 32 that are synchronized with each other; a nip roller release step S2 of releasing the carbon paper 12 from the binding by the lower nip roller 30 and the upper nip roller 32; and a cutting step S3 of cutting the carbon paper 12 that is positioned to the trim lower mold 14 and the trim upper mold 16 by delivering.

First, in order to perform the synchronous delivering step S1, the control unit 54 energizes the third lower up-and-down moving actuator 110 and the third upper up-and-down moving actuator 114 to bring the two sets of the lower grip feeds 24 and the upper grip feeds 26 close to each other. Thus, the left end and the right end of a part of the carbon paper 12 that is more on the upstream side than the trim lower mold 14 and the trim upper mold 16 are gripped by the lower grip feeds 24 and the upper grip feeds 26. In other words, the part of the carbon paper 12 that is more on the upstream side than the trim lower mold 14 and the trim upper mold 16 is bound by the lower grip feeds 24 and the upper grip feeds 26, that is, the bind state is obtained.

At the same time as, or before or after this bind state, the control unit 54 energizes the fourth lower up-and-down moving actuator 116 and the fourth upper up-and-down moving actuator 118 to bring the two sets of the lower nip rollers 30 and the upper nip rollers 32 close to each other. Thus, the left end and the right end of a part of the carbon paper 12 that is more on the downstream side than the trim lower mold 14 and the trim upper mold 16 are held by the lower nip rollers 30 and the upper nip rollers 32. That is to say, the part of the carbon paper 12 that is more on the downstream side than the trim lower mold 14 and the trim upper mold 16 is bound by the lower nip rollers 30 and the upper nip rollers 32, that is, the bind state is obtained.

At this time, the first lower up-and-down moving actuator 100, the first upper up-and-down moving actuator 102, the second lower up-and-down moving actuator 104, and the second upper up-and-down moving actuator 106 are kept to a state where the energization is stopped. Thus, the carbon paper 12 is not cut. Also, the carbon paper 12 is not held by the lower fixed chuck 20 and the upper fixed chuck 22. As described above, in the synchronous delivering step S1, the lower fixed chuck 20 and the upper fixed chuck 22 release the carbon paper 12 from binding, that is, the release state is obtained.

Next, the control unit 54 energizes the lower horizontal displacement actuator 108 and the upper horizontal displacement actuator 112 and displaces the two sets of the lower grip feeds 24 and the upper grip feeds 26 that grip the carbon paper 12 from the upstream side of the trim lower mold 14 and the trim upper mold 16 to the trim lower mold 14 and the trim upper mold 16 or the downstream side thereof. Substantially at the same time, the control unit 54 energizes the rotation driving source and rotates the lower nip roller 30 and the upper nip roller 32. By this displacement and this rotation, the carbon paper 12 is conveyed from the upstream side of the trim lower mold 14 and the trim upper mold 16 toward the trim lower mold 14 and the trim upper mold 16.

Since the lower nip roller 30 and the upper nip roller 32 rotate while the lower grip feed 24 and the upper grip feed 26 are displaced, the carbon paper 12 with a predetermined amount is delivered with high accuracy. That is to say, the conveyance accuracy is enhanced. Thus, it is possible to suppress the occurrence of a wrinkle 60 (see FIG. 4) on the carbon paper 12.

Rotation speed of the lower nip roller 30 and the upper nip roller 32 is set in accordance with displacement speed of the lower grip feed 24 and the upper grip feed 26. However, the lower nip roller 30 and the upper nip roller 32 move in a rotational manner, and on the other hand, the lower grip feed 24 and the upper grip feed 26 move in a straight manner. Thus, the moving direction of the both is different. In addition, when the lower grip feed 24 and the upper grip feed 26 grip and start to convey the carbon paper 12, the lower grip feed 24 and the upper grip feed 26 accelerate. Just before the lower grip feed 24 and the upper grip feed 26 reach a predetermined position of the trim lower mold 14 and the trim upper mold 16, the lower grip feed 24 and the upper grip feed 26 decelerate.

Figure 4:
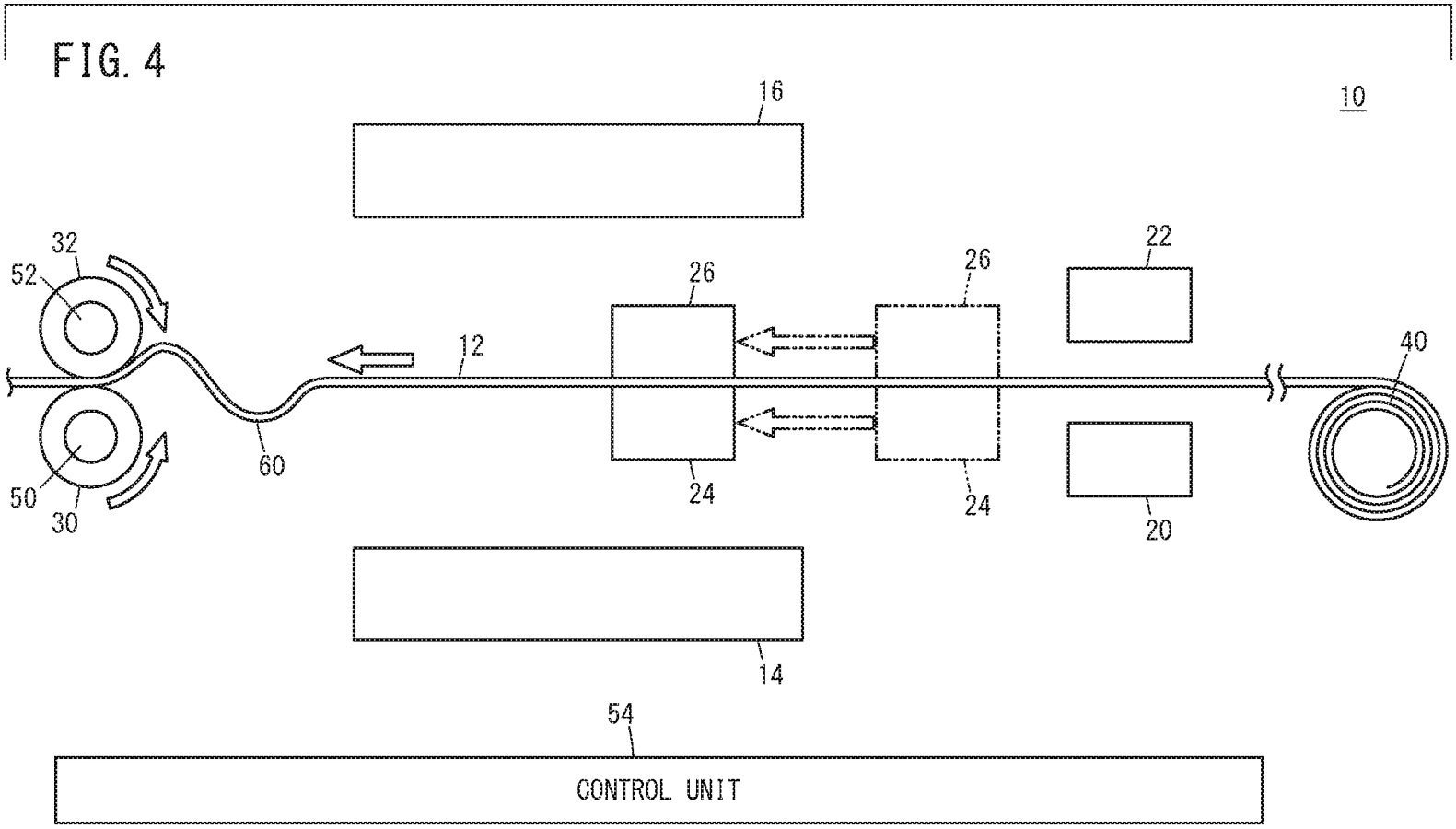
FIG. 4 is a schematic side view of the main part of the cutting device in a state where grip conveyance units in FIG. 2 are displaced toward cutting molds and a wrinkle is formed.

In this case, the displacement speed of the lower grip feed 24 and the upper grip feed 26 and the rotation speed of the lower nip roller 30 and the upper nip roller 32 may be slightly different. As a result, as illustrated in FIG. 4, even if the conveyance accuracy is high, a deflection or slack, that is, the wrinkle 60 may be formed between the part of the carbon paper 12 that is gripped by the lower grip feed 24 and the upper grip feed 26 and the part of the carbon paper 12 that is held by the lower nip roller 30 and the upper nip roller 32. When the delivery is continued in this state, stress accumulates in the wrinkle 60. Thus, a problem that the carbon paper 12 is damaged or torn occurs.

Figure 5:
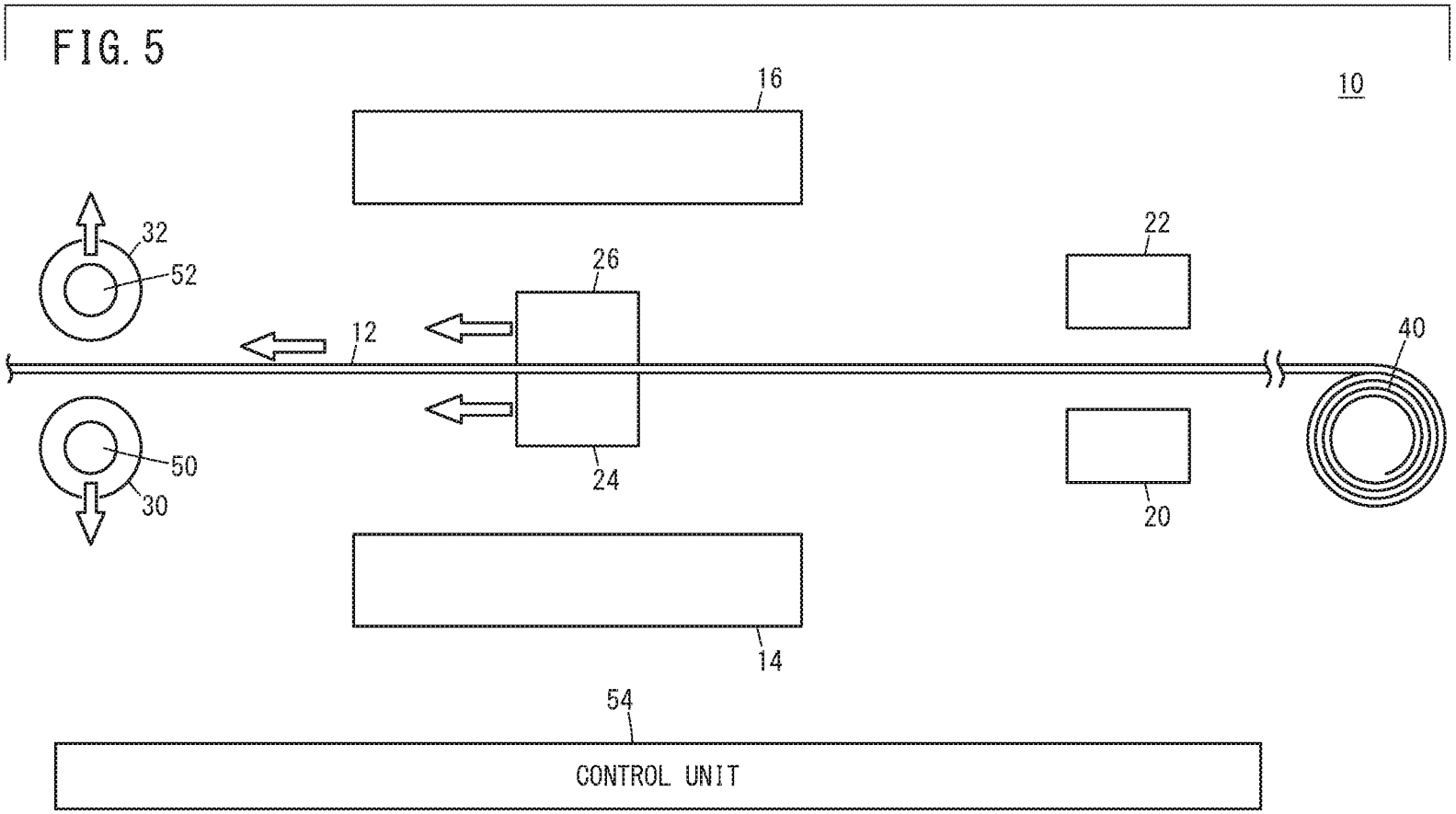
FIG. 5 is a schematic side view of the main part of the cutting device in a state where delivering units release the sheet body in FIG. 4 so that the wrinkle of the sheet body is eliminated.

In view of the above, the nip roller release step S2 is performed in order to eliminate the wrinkle 60. Specifically, the control unit 54 energizes the fourth lower up-and-down moving actuator 116 and the fourth upper up-and-down moving actuator 118 again to separate the two sets of the lower nip rollers 30 and the upper nip rollers 32 from each other. That is to say, as illustrated in FIG. 5, the lower nip roller 30 and the upper nip roller 32 release the carbon paper 12 from binding, that is, the release state is obtained. On the other hand, the lower grip feed 24 and the upper grip feed 26 keep the carbon paper 12 gripped (bind state).

The carbon paper 12 is an elastic body. Thus, when the lower nip roller 30 and the upper nip roller 32 release the carbon paper 12 while the lower grip feed 24 and the upper grip feed 26 bind the carbon paper 12, the carbon paper 12 spontaneously lengthens by the elastic action. As the carbon paper 12 lengthens, the wrinkle 60 is eliminated. After that, the control unit 54 energizes the fourth lower up-and-down moving actuator 116 and the fourth upper up-and-down moving actuator 118 again, and brings the two sets of the lower nip rollers 30 and the upper nip rollers 32 close to each other to hold the carbon paper 12. That is to say, the lower nip roller 30 and the upper nip roller 32 are set to the bind state again. In this state, by the lower grip feed 24 and the upper grip feed 26 that are displaced and the lower nip roller 30 and the upper nip roller 32 that rotate, the carbon paper 12 is further delivered.

It only requires several seconds after the lower nip roller 30 and the upper nip roller 32 release the carbon paper 12 from binding and until the lower nip roller 30 and the upper nip roller 32 bind the carbon paper 12 again. In some cases, this time can be set to about one second.

The predetermined amount of the carbon paper 12 is delivered. Just before a part of the carbon paper 12 to be cut reaches a position between the trim lower mold 14 and the trim upper mold 16, the energization for the lower horizontal displacement actuator 108 and the upper horizontal displacement actuator 112 is stopped in order to stop the displacement of the lower grip feed 24 and the upper grip feed 26. Accordingly, the lower grip feed 24 and the upper grip feed 26 decelerate.

At this time, it is not particularly necessary to bind the carbon paper 12 by the lower nip roller 30 and the upper nip roller 32. Thus, the fourth lower up-and-down moving actuator 116 and the fourth upper up-and-down moving actuator 118 may be energized to separate the lower nip roller 30 and the upper nip roller 32 from each other. In this case, since the carbon paper 12 is not bound by the lower nip roller 30 and the upper nip roller 32, the carbon paper 12 can be delivered faster.

When the predetermined amount of the carbon paper 12 is delivered and the part of the carbon paper 12 to be cut is positioned between the trim lower mold 14 and the trim upper mold 16, the energization for the rotation driving force is stopped. That is to say, both the displacement of the lower grip feed 24 and the upper grip feed 26 and the rotation of the lower nip roller 30 and the upper nip roller 32 are stopped. The control unit 54 energizes the third lower up-and-down moving actuator 110 and the third upper up-and-down moving actuator 114 to separate the lower grip feed 24 and the upper grip feed 26 from each other. Thus, the binding by the carbon paper 12 is released, that is, the release state is obtained.

Moreover, the lower horizontal displacement actuator 108 and the upper horizontal displacement actuator 112 are energized again, so that the lower grip feed 24 and the upper grip feed 26 are displaced from the trim lower mold 14 and the trim upper mold 16 to the upstream side thereof. That is to say, the lower grip feed 24 and the upper grip feed 26 return to the original positions.

At the same time as, or before or after the lower grip feed 24 and the upper grip feed 26 make a transition to the release state, the control unit 54 energizes the second lower up-and-down moving actuator 104 and the second upper up-and-down moving actuator 106 to bring the lower fixed chuck 20 and the upper fixed chuck 22 close to each other. Thus, the carbon paper 12 is held, that is, the bind state is obtained. That is to say, at this time, the carbon paper 12 is held by the lower fixed chuck 20 and the upper fixed chuck 22, is held by the lower nip roller 30 and the upper nip roller 32, and is released from the lower grip feed 24 and the upper grip feed 26.

The lower fixed chuck 20 and the upper fixed chuck 22 are positioned and fixed, and are not displaced. The rotation of the lower nip roller 30 and the upper nip roller 32 is stopped. Thus, at this time, the carbon paper 12 is not delivered. That is to say, the carbon paper 12 is held by the lower fixed chuck 20 and the upper fixed chuck 22, and at the same time, is held by the lower nip roller 30 and the upper nip roller 32. Thus, the carbon paper 12 is positioned and fixed.

Figure 6:
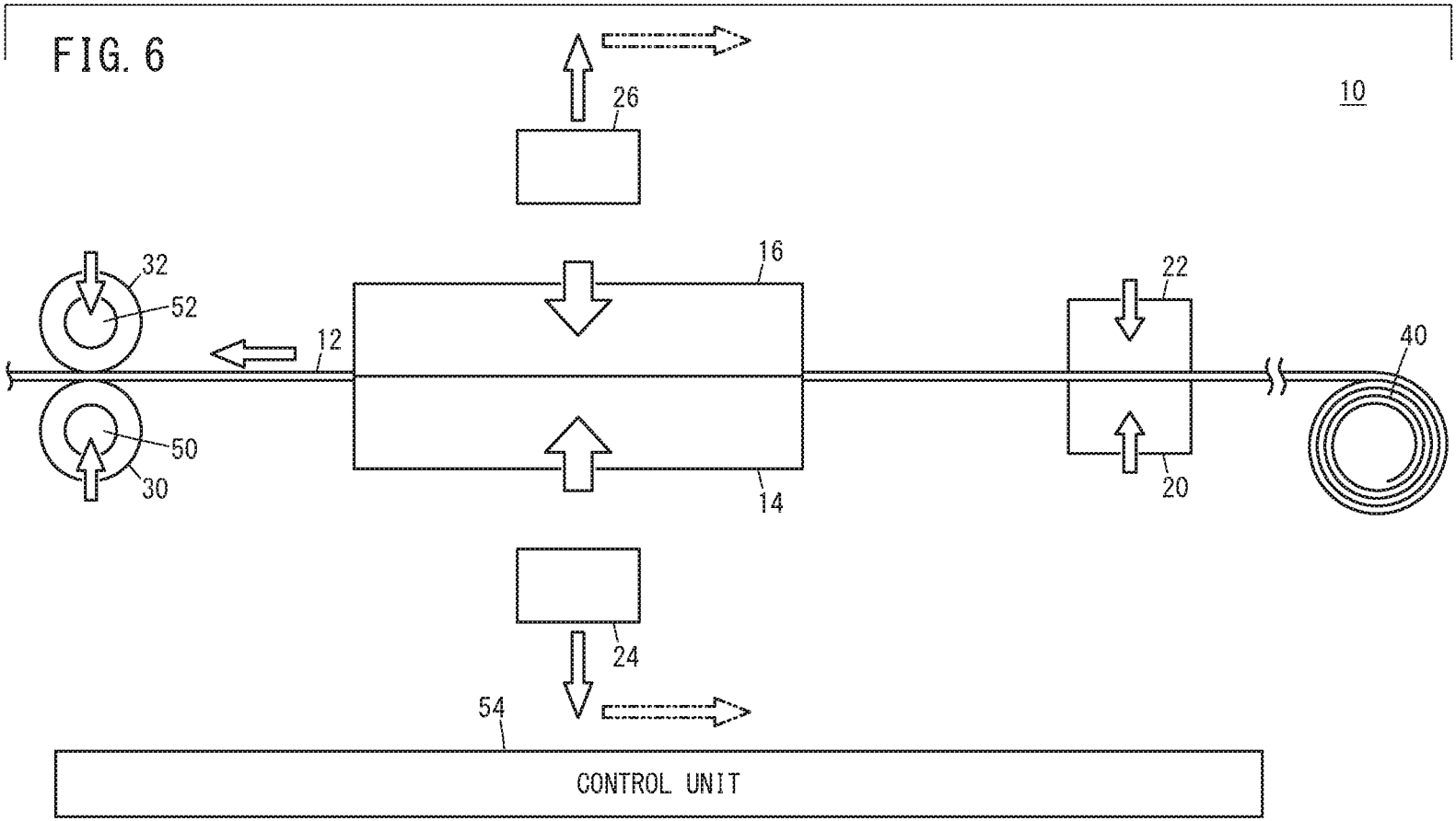
FIG. 6 is a schematic side view of the main part of the cutting device in a state where the grip conveyance units release the sheet body, holding units and the delivering units bind the sheet body, and the cutting molds cut the sheet body in predetermined size and shape.

Next, the cutting step S3 is performed. That is to say, the control unit 54 energizes the first lower up-and-down moving actuator 100 and the first upper up-and-down moving actuator 102 to bring the trim lower mold 14 and the trim upper mold 16 close to each other as illustrated in FIG. 6. As a result, the carbon paper 12 is cut at the position of the trim lower mold 14 and the trim upper mold 16 to obtain a cut piece with the predetermined size and shape.

When the delivering and the cutting are performed next time, the above synchronous delivering step S1, nip roller release step S2, and cutting step S3 are performed again.

The present invention is not particularly limited to the embodiment described as above, and can be variously modified in the range without departing from the concept of the present invention.

For example, in this embodiment, the lower fixed chuck 20, the lower grip feed 24, and the lower nip roller 30 can ascend and descend, and the upper fixed chuck 22, the upper grip feed 26, and the upper nip roller 32 can also ascend and descend. It is only necessary that these units that have the carbon paper 12 therebetween can be brought close to or separated from each other relatively. That is to say, for example, only the upper fixed chuck 22, the upper grip feed 26, and the upper nip roller 32 may be able to ascend and descend so as to be separated from the lower fixed chuck 20, the lower grip feed 24, and the lower nip roller 30, respectively.

Moreover, in this embodiment, the lower grip feed 24 and the upper grip feed 26 are structured to be horizontally displaced from the upstream side to the downstream side of the trim lower mold 14 and the trim upper mold 16. However, the lower grip feed 24 and the upper grip feed 26 may be structured to be horizontally displaced on only the downstream side or only the upstream side of the trim lower mold 14 and the trim upper mold 16. By this structure, while the trim lower mold 14 and the trim upper mold 16 are driven so as to cut the carbon paper 12, the lower grip feed 24 and the upper grip feed 26 that are separated from each other, that is, in the release state can return to the original positions. By this way, the time from the synchronous delivering step S1 to the cutting step S3 can be reduced.

In addition, it is needless to say that the sheet body is not limited to the carbon paper 12.

What is claimed is:

1. A sheet body cutting method for cutting a sheet body with cutting molds of a sheet body cutting device that includes a holding member, a grip conveyance member, a delivering member, and the cutting molds, wherein the holding member provided on an upstream side of the cutting molds includes:

two holding units that hold the sheet body, and an actuator that is positioned and fixed and displaces one of the holding units in a direction in which the one of the holding units is brought close to or separated from the other of the holding units, wherein the grip conveyance member includes:

two grip conveyance units that hold the sheet body, and a horizontal displacement actuator that displaces the two grip conveyance units in a horizontal direction, and an actuator that displaces one of the grip conveyance units in directions in which one of the grip conveyance units is brought close to or separated from the other of the grip conveyance units, wherein the delivering member is provided on a downstream side of the cutting molds and includes:

two delivering units that hold the sheet body and deliver the sheet body downstream, and an actuator that displaces one of the delivering units in directions in which the one of the delivering units is brought close to or separated from the other of the delivering units, and the sheet body cutting method comprising:

a synchronous delivering step of positioning the sheet body at the cutting molds in a manner that the two holding units are separated from each other relatively so as to release the sheet body, the two grip conveyance units grip and convey the sheet body from the upstream side of the cutting molds toward the cutting molds, the two delivering units are brought close to each other relatively so as to hold the sheet body, and deliver a part of the sheet body to a downstream side; and a cutting step of cutting the sheet body in a manner that the two holding units are brought close to each other relatively so as to hold the sheet body, the two delivering units keep holding the sheet body, the two grip conveyance units are separated from each other relatively so as to release the sheet body from gripping, and the cutting molds cut the sheet body that has been positioned at the cutting molds.

2. The sheet body cutting method according to claim 1, wherein in the synchronous delivering step, the two delivering units are separated from each other relatively so that the sheet body is temporarily released from holding by the two delivering units, and subsequently the two delivering units are brought close to each other and hold the sheet body again, and the two grip conveyance units and the two delivering units continue to deliver the sheet body.

3. The sheet body cutting method according to claim 1, wherein after the synchronous delivering step, when the two grip conveyance units return to original positions on the upstream side, the two holding units are configured to hold the sheet body, the two grip conveyance units are configured to release the sheet body, and the two delivering units are configured to release the sheet body.

* * * * *